US009140425B2

(12) United States Patent
Kinzer et al.

(10) Patent No.: US 9,140,425 B2
(45) Date of Patent: Sep. 22, 2015

(54) CYC ATTACHMENT FOR A LIGHT ENGINE

(71) Applicant: Electronic Theatre Controls, Inc., Middleton, WI (US)

(72) Inventors: David Kinzer, Baraboo, WI (US); Frank Tornyai, Madison, WI (US); Sunya Nimityongskul, Madison, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 89 days.

(21) Appl. No.: 13/783,823

(22) Filed: Mar. 4, 2013

(65) Prior Publication Data

US 2014/0247602 A1 Sep. 4, 2014

(51) Int. Cl.

| | |
|---|---|
| ***F21V 7/00*** | (2006.01) |
| ***F21V 5/00*** | (2015.01) |
| ***F21V 13/04*** | (2006.01) |
| ***F21V 17/00*** | (2006.01) |
| *F21W 131/406* | (2006.01) |

(52) U.S. Cl.

CPC ..... *F21V 5/008* (2013.01); *F21V 13/04* (2013.01); *F21V 17/002* (2013.01); *F21V 7/0008* (2013.01); *F21W 2131/406* (2013.01)

(58) Field of Classification Search

CPC ..... F21V 13/04; F21V 5/008

USPC ..... 362/231, 235, 558, 296.01, 308, 333, 362/326

See application file for complete search history.

(56) References Cited

U.S. PATENT DOCUMENTS

| | | | | |
|---|---|---|---|---|
| 4,293,892 | A | 10/1981 | Plummer | |
| 6,220,731 | B1 | 4/2001 | Ryan | |
| 6,244,730 | B1 * | 6/2001 | Goldberg et al. | 362/268 |
| 6,254,246 | B1 * | 7/2001 | Tiao et al. | 362/614 |
| 6,832,845 | B1 * | 12/2004 | Kretzschmar et al. | 362/277 |
| 6,926,427 | B2 | 8/2005 | Tawil et al. | |
| 7,517,088 | B1 * | 4/2009 | Kretzschmar et al. | 353/43 |
| 7,963,673 | B2 * | 6/2011 | Finn | 362/249.03 |
| 8,152,332 | B2 * | 4/2012 | Ryan | 362/235 |
| 8,388,178 | B2 | 3/2013 | Ryan | |
| 2004/0085770 | A1 | 5/2004 | Tyler et al. | |
| 2004/0240055 | A1 * | 12/2004 | Teramoto et al. | 359/457 |
| 2005/0052872 | A1 | 3/2005 | de Peralta | |
| 2005/0068617 | A1 * | 3/2005 | Mizuno et al. | 359/443 |

(Continued)

FOREIGN PATENT DOCUMENTS

| | | | |
|---|---|---|---|
| DE | 19732657 | A1 | 2/1998 |
| EP | 1167868 | A2 | 1/2002 |

(Continued)

OTHER PUBLICATIONS

PCT International Search Report and Written Opinion for PCT Application No. PCT/US2014/015998 dated Jun. 20, 2014 (17 pages).

(Continued)

*Primary Examiner* — Ali Alavi

(74) *Attorney, Agent, or Firm* — Michael Best & Friedrich LLP

(57) ABSTRACT

A luminaire including a light engine having a light source and a housing and a light-diffusing attachment that includes a frame secured to the housing of the light engine, a refracting lens supported by the frame, and a diffuser supported by the frame.

24 Claims, 15 Drawing Sheets

(56) References Cited

U.S. PATENT DOCUMENTS

| | | | | |
|---|---|---|---|---|
| 2006/0291050 | A1* | 12/2006 | Shestak et al. | 359/443 |
| 2007/0002439 | A1* | 1/2007 | Sekiguchi | 359/457 |
| 2007/0177263 | A1* | 8/2007 | Ono | 359/457 |
| 2009/0147365 | A1* | 6/2009 | Inokuma et al. | 359/599 |
| 2009/0231855 | A1 | 9/2009 | Esakoff et al. | |
| 2012/0140463 | A1 | 6/2012 | Kinzer et al. | |
| 2014/0140463 | A1* | 5/2014 | Walton et al. | 376/219 |

FOREIGN PATENT DOCUMENTS

| | | | |
|---|---|---|---|
| EP | 1677044 | A1 | 7/2006 |
| WO | 2007122459 | A2 | 11/2007 |

OTHER PUBLICATIONS

International Written Opinion for Application No. PCT/US2014/015998 dated Feb. 24, 2015 (7 pages).

* cited by examiner

CYC ATTACHMENT FOR A LIGHT ENGINE

BACKGROUND

The present invention relates to theatrical lighting and, more specifically, to cyc lighting devices.

Theatres use many different types of lights, such as flood lights and spotlights to achieve a variety of lighting effects. Often, it is desirable to light a large curtain or wall, commonly called a cyclorama or "cyc," with a smooth light wash. Lighting of cycs is typically done using a cyc light, which produces a diffused light wash that provides even coverage on the surface of the cyc.

SUMMARY

In one embodiment, the invention provides a light-diffusing attachment for a light engine having a housing. The attachment includes a frame adapted to be secured to the housing of the light engine, a refracting lens supported by the frame, and a diffuser supported by the frame.

In another embodiment the invention provides a luminaire including a light engine having a light source and a housing and a light-diffusing attachment that includes a frame secured to the housing of the light engine, a refracting lens supported by the frame, and a diffuser supported by the frame.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
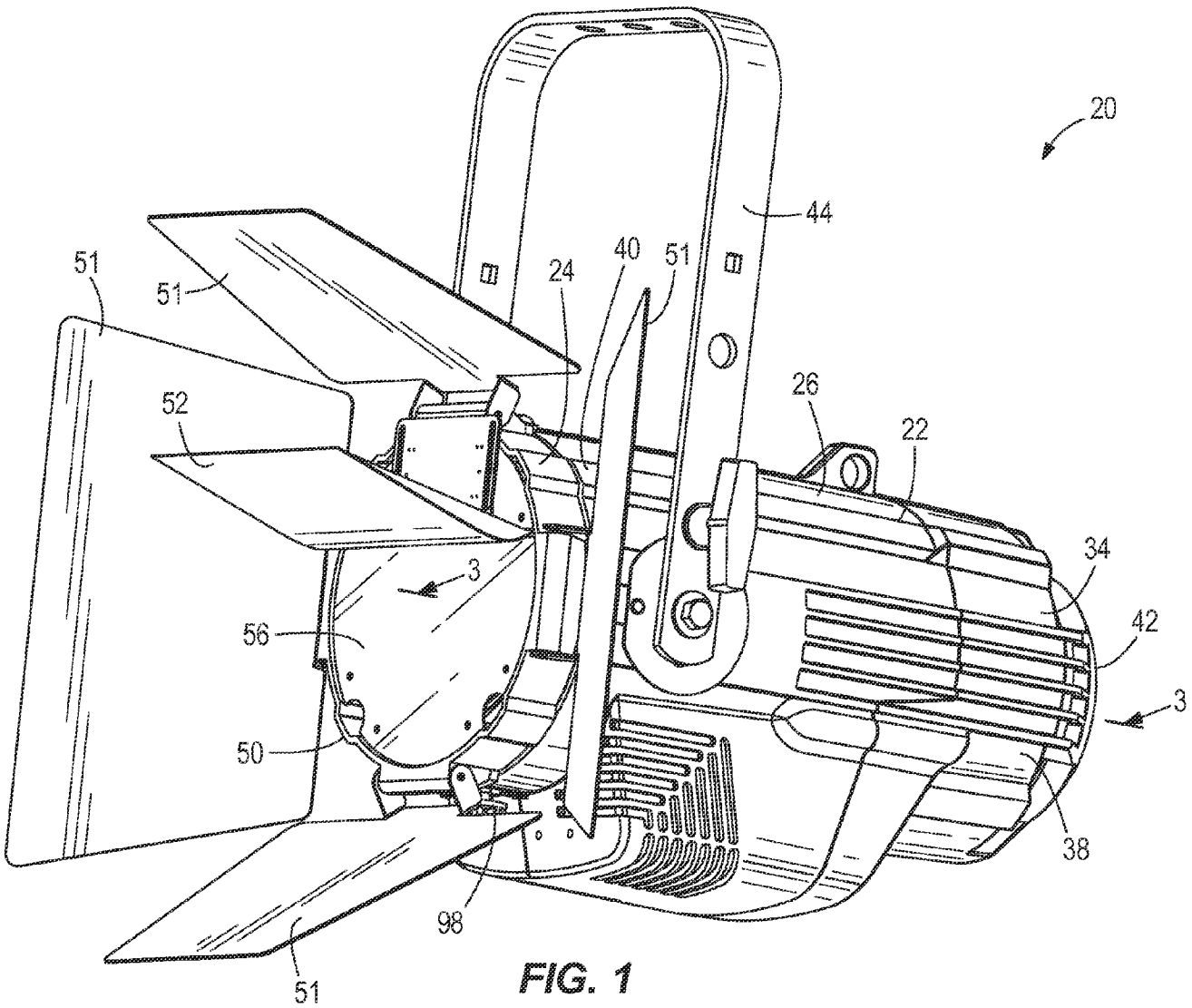
FIG. 1 is a perspective view of a luminaire embodying the present invention.
Figure 3:
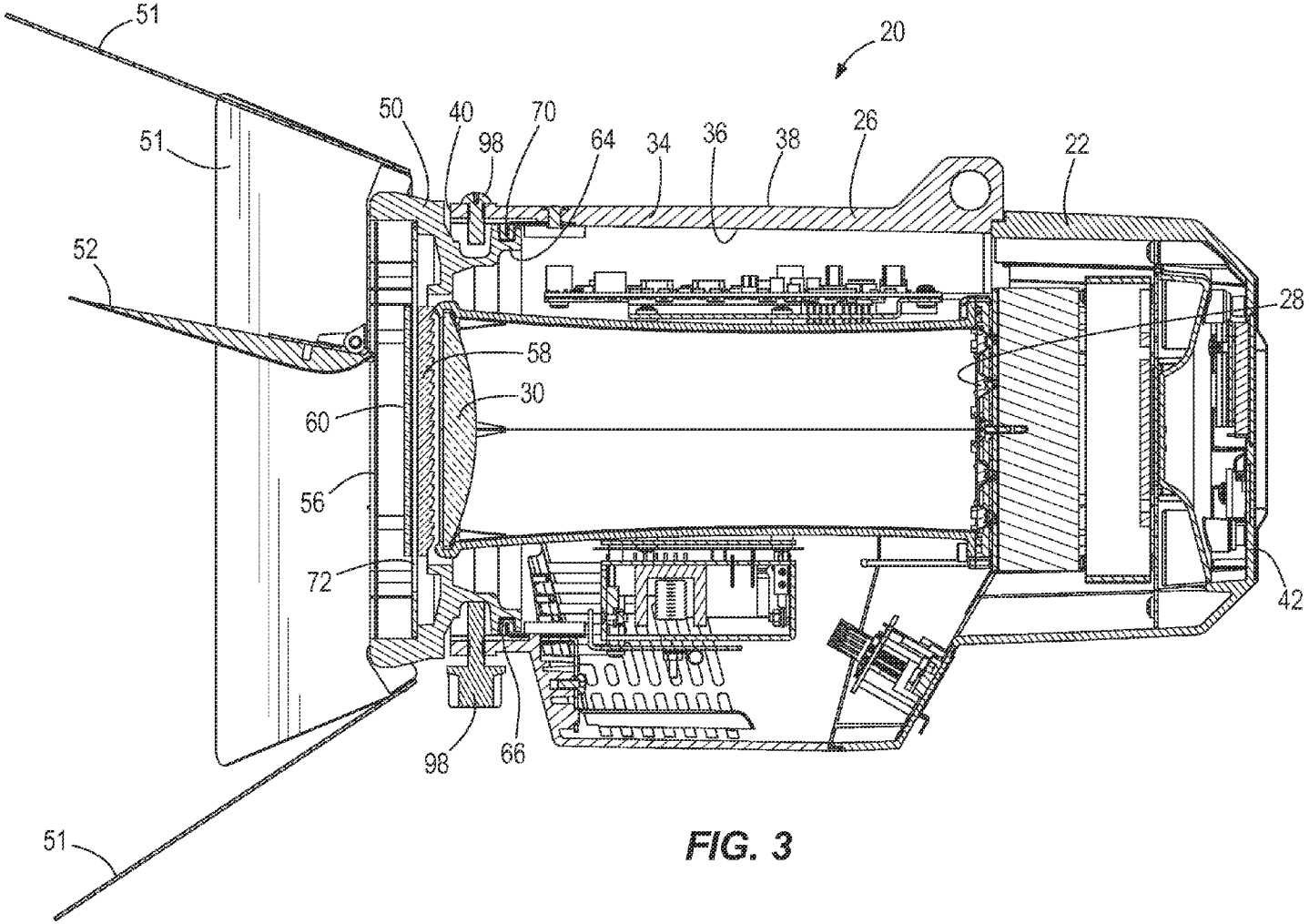
FIG. 3 is a cross-sectional view taken along lines 3-3 of FIG. 1.

FIG. 1 illustrates a luminaire 20, which is a cyclorama luminaire or cyc light. Referring to FIGS. 1 and 3, the cyc light 20 includes a light engine 22 and a light diffusing attachment 24. The light engine 22 includes a housing 26, a light source 28, and a field lens 30.

The housing 26 includes a cylindrical portion 34 having an inner surface 36 and an outer surface 38. The cylindrical portion 34 further includes an open first end 40 and a closed second end 42 opposite the first end 40. A generally U-shaped frame 44 is pivotally coupled to the housing 26 and can be used to attach the light 20 to a support structure. The light source 28 is located within the cylindrical portion 34 of the housing 26 adjacent the closed end 42. In one embodiment, the light source 28 includes an array of light-emitting diodes ("LEDs"), and in other embodiments the light source 28 can include other suitable light sources, such as an incandescent light bulb. In one embodiment, the light engine 22 can be a Source Four LED™ light engine provided by Electronic Theater Controls, Inc.

Figure 2:
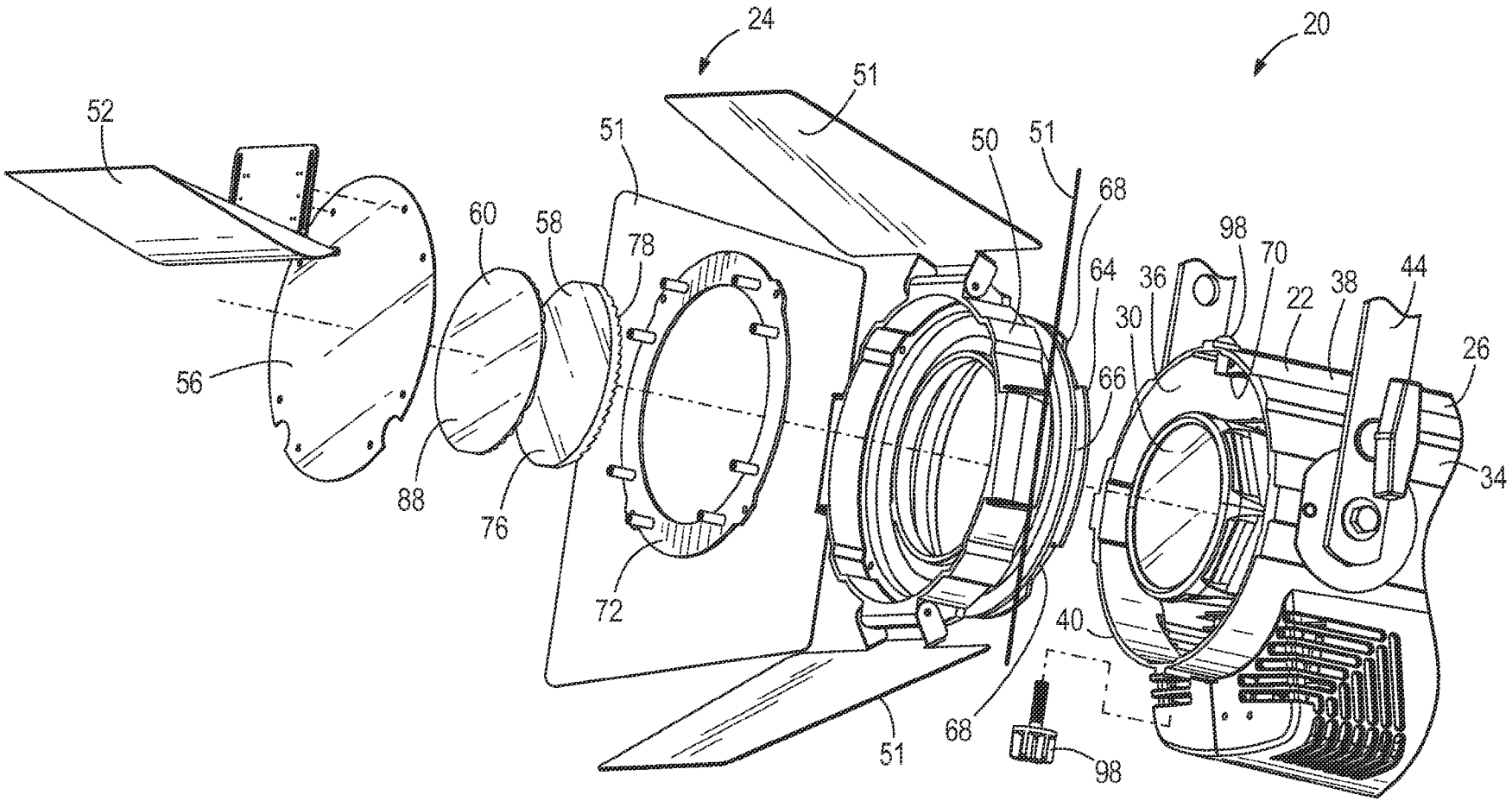
FIG. 2 is a partially exploded view of the luminaire of FIG. 1.

Referring to FIGS. 2 and 3, the light diffusing attachment 24 is removably attached to the light engine 22 so that the light engine 22 can quickly and easily be converted to a cyc light. The illustrated attachment 24 includes a frame 50, doors 51, a steering mirror 52, a diffuser 56, a first refracting lens 58, and a second refracting lens 60.

Figure 4:
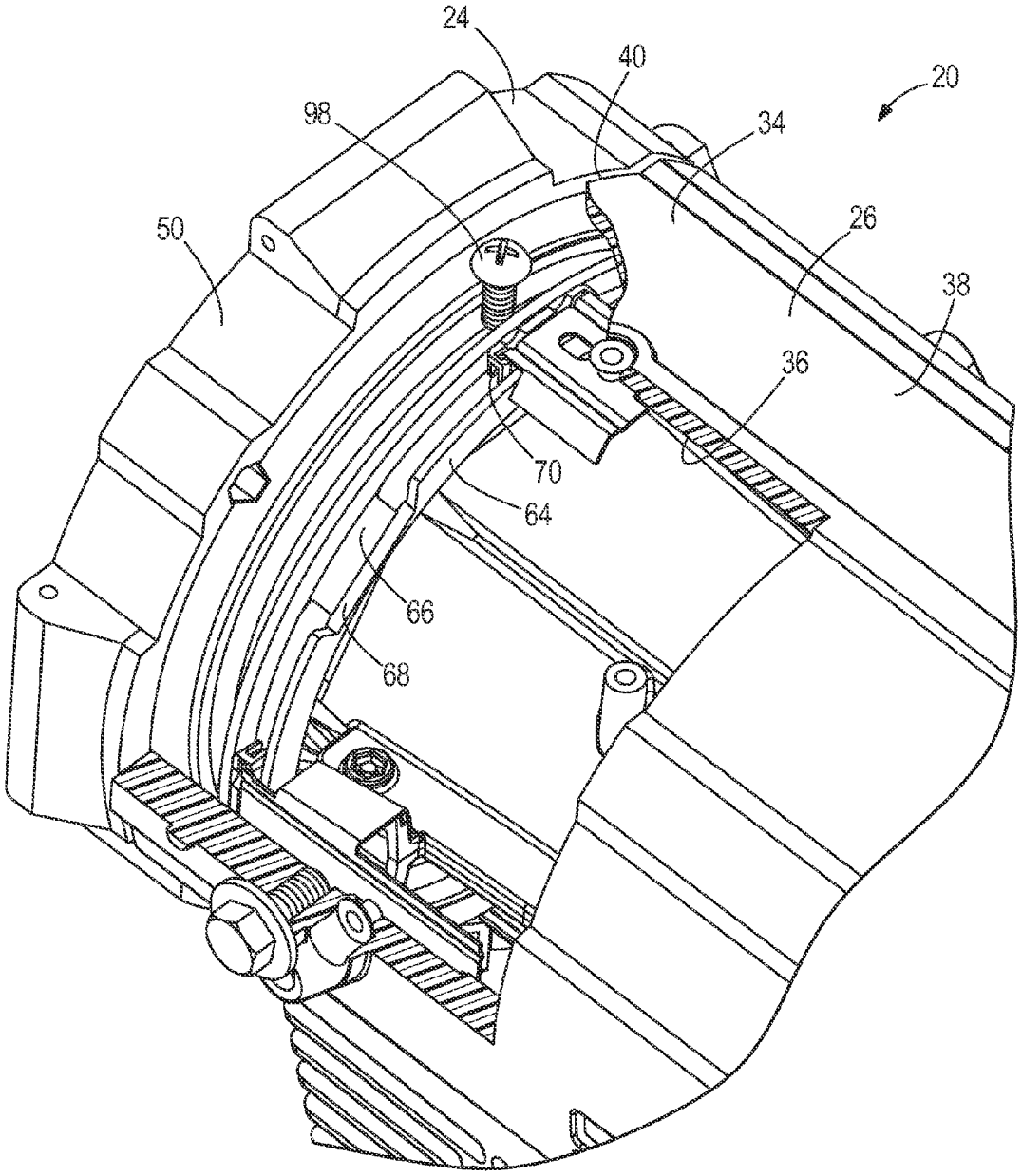
FIG. 4 is a partial perspective view of the luminaire of FIG. 1 with a portion of a housing of the luminaire removed.

The frame 50 is configured to be removably coupled to the housing 26. As discussed in more detail below, the user can attach, remove, and reattach the frame 50 to the housing 26 to convert the light engine 22 to a cyc light. The frame 50 is cast from aluminum, in one embodiment, and includes a supporting flange 64. The supporting flange 64 defines a groove 66 that extends around the frame 50. Openings 68 extend through the flange 64. As best seen in FIGS. 3 and 4, tabs 70 extend from the inner surface 36 of the housing 26. The tabs 70 are received in the groove 66 to couple the frame 50 to the housing 26.

The diffuser 56 is supported by the frame 50 and is coupled to the frame 50 via a bezel 72. In one embodiment, the diffuser 56 is a holographic diffuser, but in other embodiments, other types of diffusers can be utilized. The first refracting lens 58 and the second refracting lens 60 are supported by the frame 50 between the diffuser 56 and the field lens 30. In the illustrated embodiment, the lenses 58, 60 are lenticular lenses.

Figure 5:
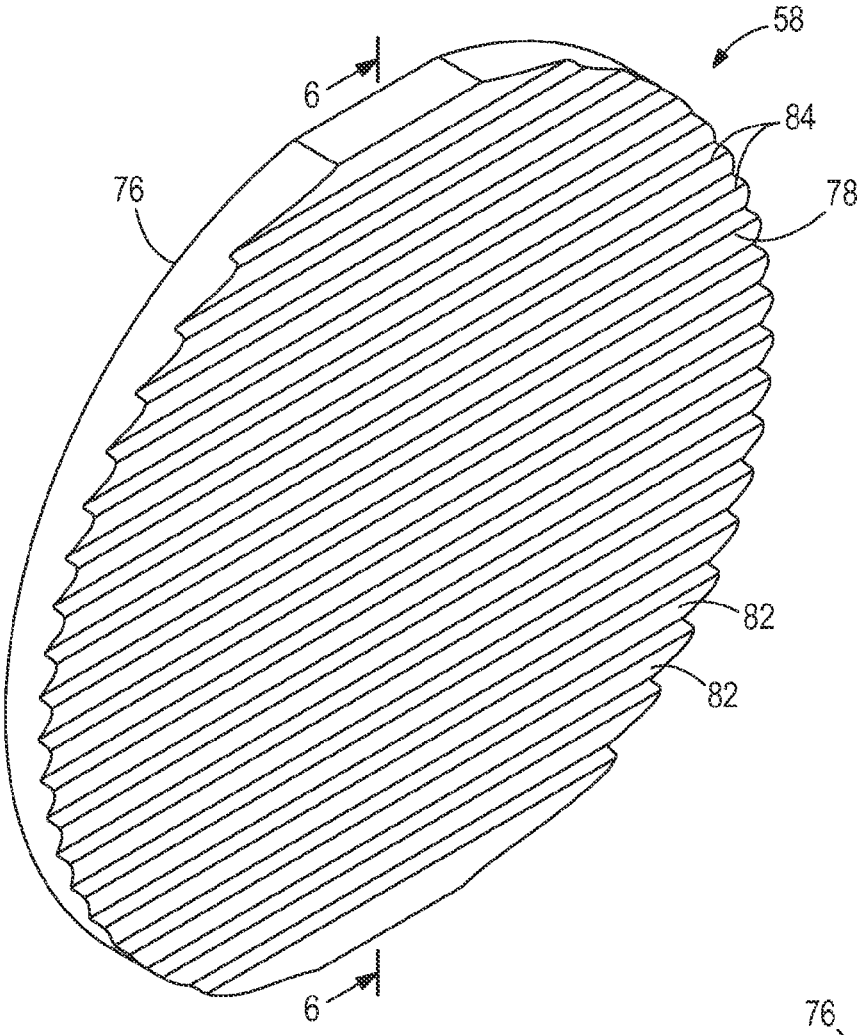
FIG. 5 is a perspective view of a first lens of the luminaire of FIG. 1.
Figure 6:
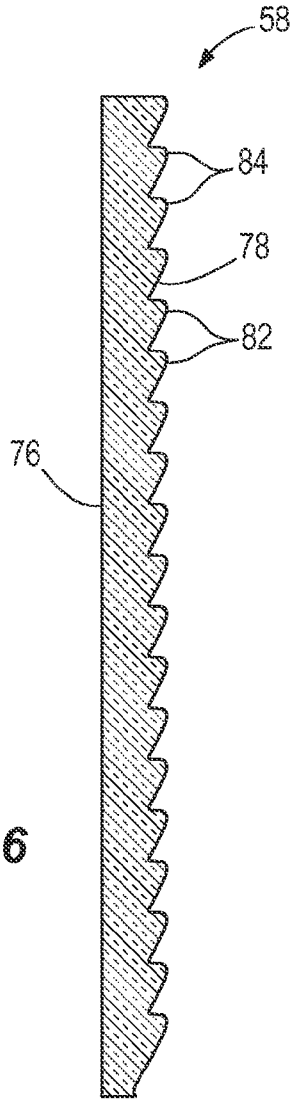
FIG. 6 is a cross-sectional view taken along lines 6-6 of FIG. 5.

Referring to FIGS. 5 and 6, the first refracting lens 58 includes a first side 76 and an opposite second side 78. The first side 76 is generally smooth and the second side 78, which faces toward the light source 28, includes a first array of stepped lenses 82 having a first orientation. The first array of stepped lenses 82 arranged in a horizontal array. Each of the illustrated lenses 82 includes a rounded tip 84. The lenses 82 steer the beam from the light source 28 vertically while also smearing the light beam vertically due to the round tips 84.

Figure 7:
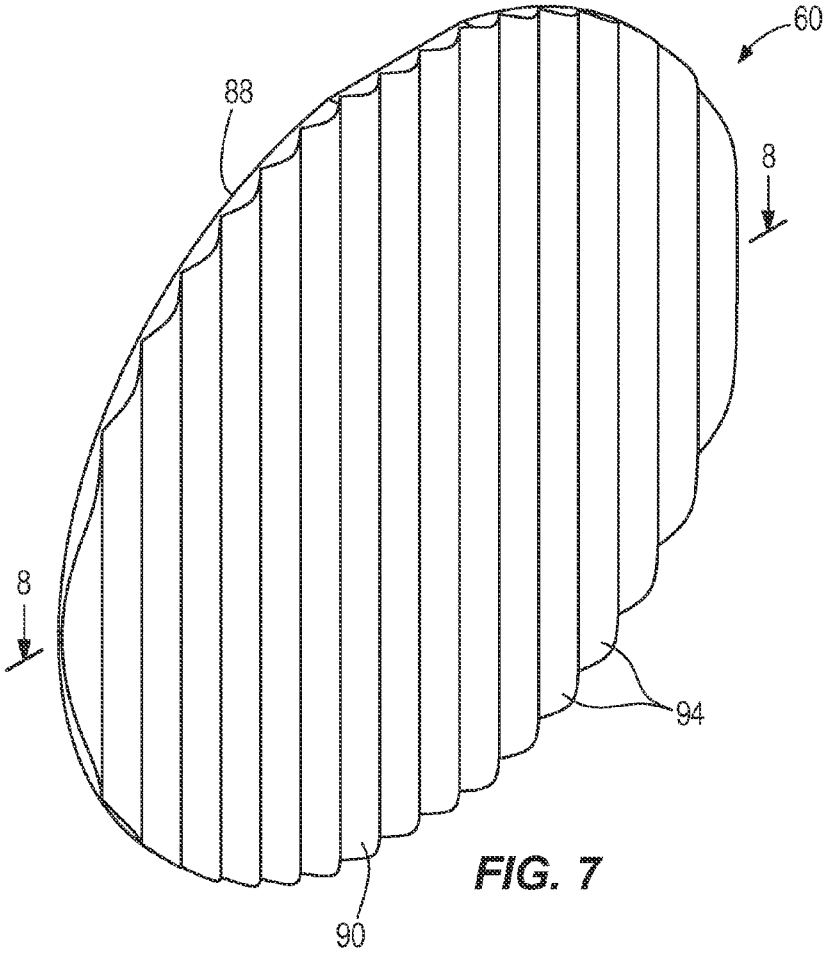
FIG. 7 is a perspective view of a second lens of the luminaire of FIG. 1.
Figure 8:
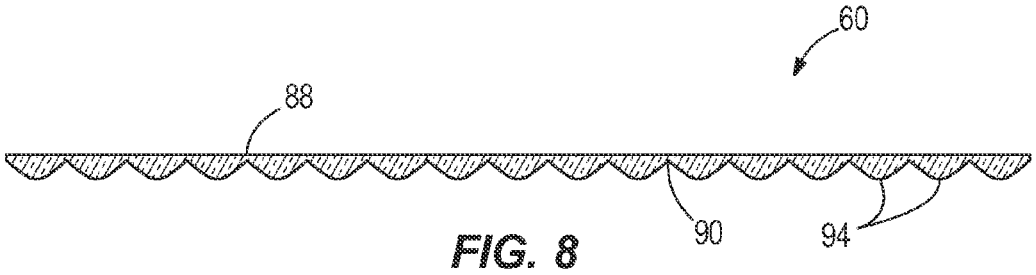
FIG. 8 is a cross-sectional view taken along lines 8-8 of FIG. 7.

Referring to FIGS. 7 and 8, the second lens 60 includes a first side 88 and an opposite second side 90. The first side 88 is generally smooth and the second side 90, which faces toward the light source 28, includes a second array of cylindrical lenses 94 having a second orientation that is different than the first orientation of the first array of stepped lenses 82. In the illustrated embodiment, the orientation of the second array of cylindrical lenses 94 is rotated 90 degrees from the orientation of the first array of stepped lenses 82. The multiple cylindrical lenses 94 are arranged in a vertical array. In one embodiment, the cylindrical lenses 94 have a conic constant of about −2 and a radius to width ratio of about 0.25. The cylindrical lenses 94 in the vertical array spread the light beam from the light source 28 horizontally.

In operation, the user can easily and quickly change the luminaire 20 to a cyc light by securing the light-diffusing attachment 24 to the light engine 22. To attach the illustrated light-diffusing attachment 24 to the light engine 22, the user aligns the tabs 70 (FIG. 4) with the openings 68 in the flange 64 of the frame 50, and the user inserts the frame 50 into the open first end 40 of the housing 26 so that the tabs 70 pass through the openings 68 and into the groove 66. Then, the user rotates the frame 50 relative to the housing 26 so that the tabs 70 become misaligned with the openings 68 as illustrated in FIG. 4, which secures the attachment 24 to the housing 26. As best seen in FIG. 3, the user can also insert fasteners 98 through the housing to provide additional securing of the frame 50 to the housing 26. The luminaire 20, including the attachment 24, can then be used as a cyc light. For example, the cyc light 20 is pointed upwards at an angle of about 60 degrees and is positioned about 2 to 4 feet back from a cyc. The lenses 58,60 spread the light beam from the light source 28 vertically and horizontally as discussed above. The diffuser 56 smooths out any remaining non-uniformities in the light. Therefore, the attachment 24 provides a light profile that covers a large area of the cyc, and the light profile is homogeneous and falls off in a smooth well-defined manner both horizontally and vertically. The steering mirror 52 recovers otherwise wasted light and redirects it toward the cyc.

Figure 9:
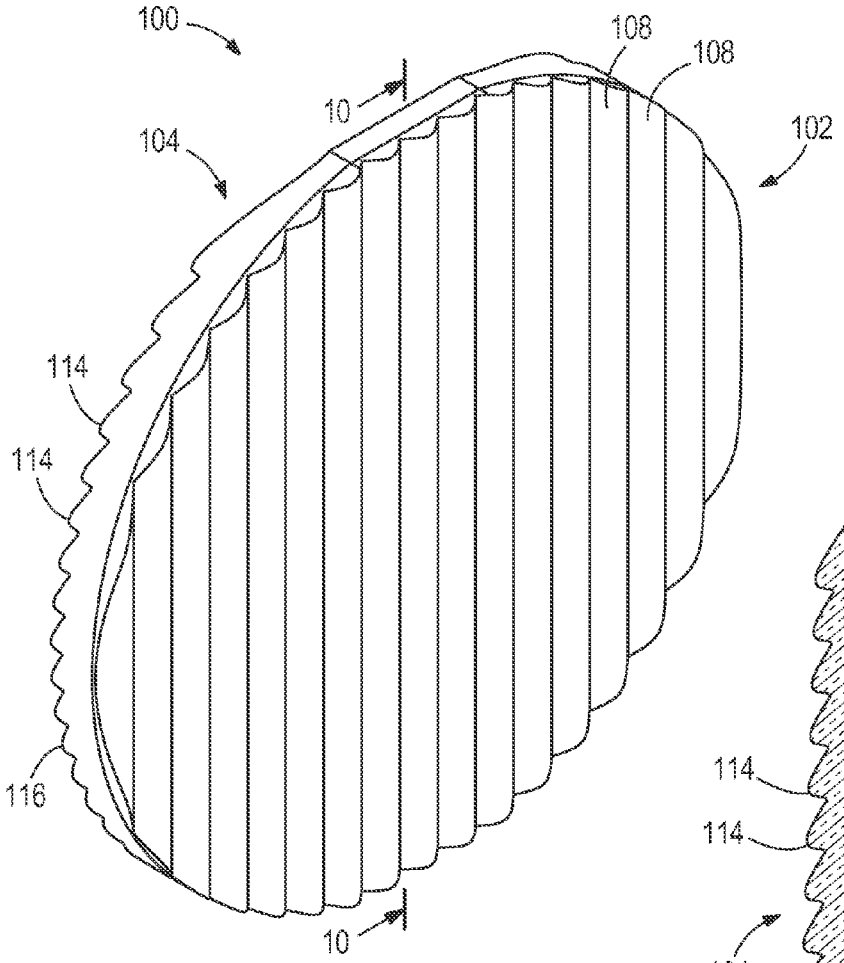
FIG. 9 is a perspective view of a first alternative lens for use in the luminaire of FIG. 1.
Figure 10:
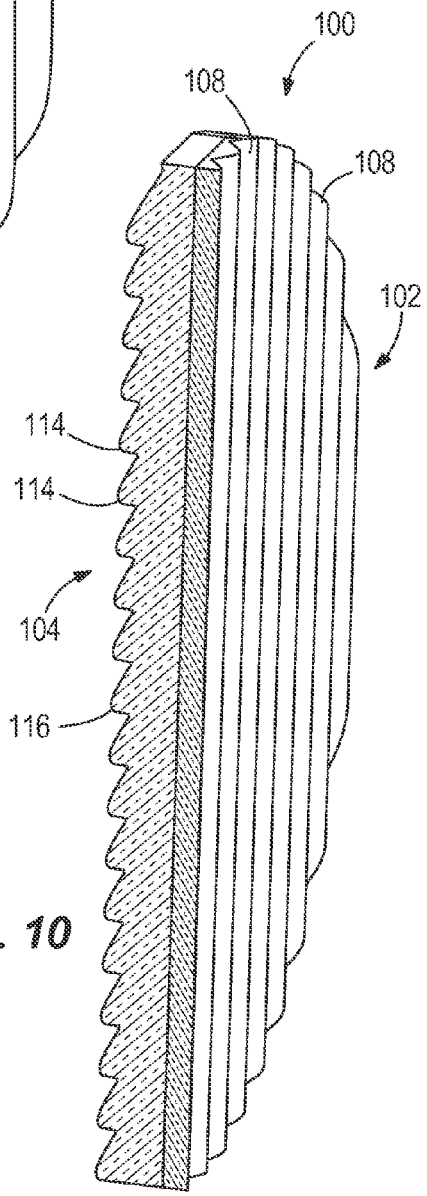
FIG. 10 is a cross-sectional view taken along lines 10-10 of FIG. 9.

FIGS. 9 and 10 illustrate a refracting lens 100 that can be used with the attachment 24 discussed above in lieu of the lenses 58 and 60. The lens 100 is a double-sided lenticular lens and includes a first side 102 and second side 104. The first side 102 includes a first array of cylindrical lenses 108 with a first orientation in the form of a vertical array. In one embodiment, the lens 108 have a conic constant of about −2 and a radius to width ratio of about 0.25. The lenses 108 spread the light beam horizontally. The second side 104 includes a second array of multiple-stepped lenses 114 with a second orientation different than the orientation of the first array 106. In the illustrated embodiment, the second array of lenses 114 is a horizontal array (i.e., rotated about 90 degrees from the orientation of the first array 106). Each of the illustrated multiple-stepped lenses 114 includes a rounded tip 116. The lenses 114 steer the beam from the light source 28 vertically while also smearing the light beam vertically due to the round tips 116.

Figure 11:
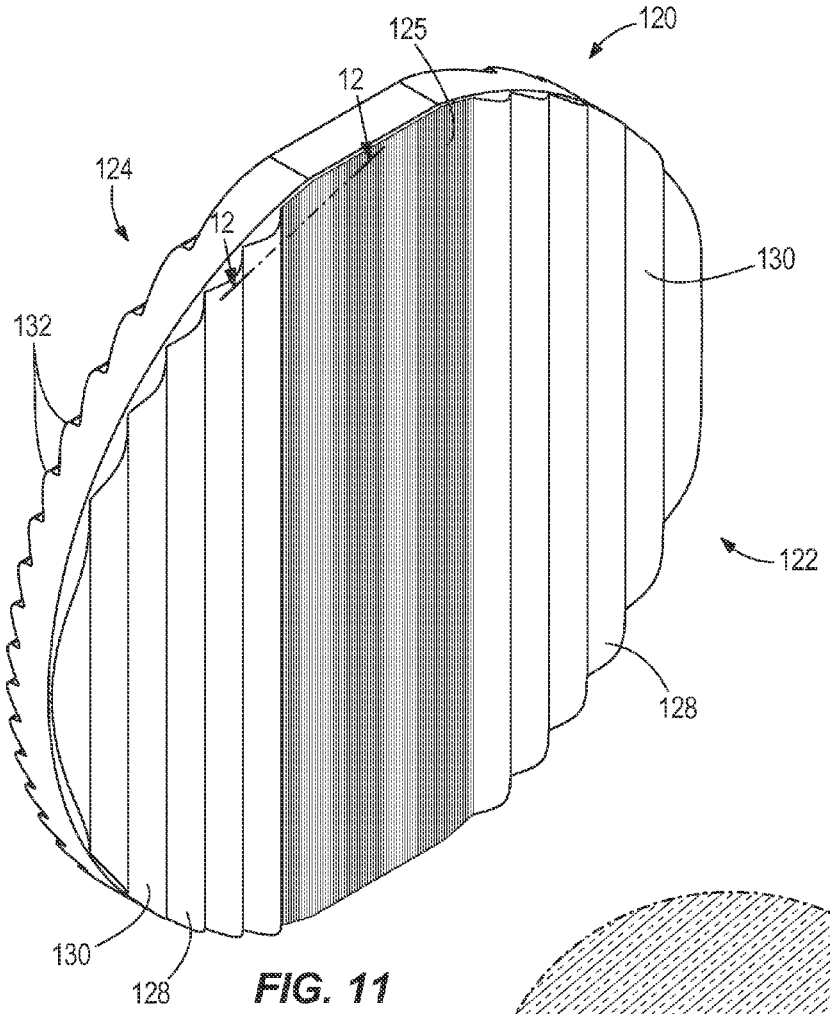
FIG. 11 is a perspective view of a second alternative lens for use in the luminaire of FIG. 1.
Figure 12:
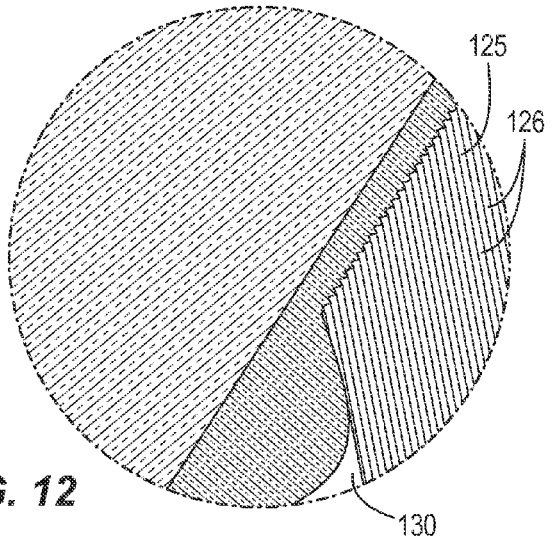
FIG. 12 is an enlarged cross-sectional view of a portion of the lens of FIG. 11.

FIGS. 11 and 12 illustrate a refracting lens 120 that can be used with the attachment 24 discussed above in lieu of either the lenses 58, 60, or 100. The lens 120 includes a first side 122 and a second side 124. The first side 122 includes a central region 125 including prisms 126, which are 90 degree prisms in the illustrated embodiment. The prisms 126 split the light beam from the light source 28 and create a wide spread of about +/−30 degrees. Peripheral regions 128 of the first side 122 (i.e., peripheral to the central region 125) include cylindrical lenses 130 arranged in a vertical array similar to the cylindrical lenses 108 discussed above with regard to the refracting lens 100 of FIGS. 9 and 10. The second side 124 of the lens 120 includes a horizontal array of multi-stepped lenses 132 similar to the multi-stepped lenses 114 discussed above with regard to the refracting lens 100 of FIGS. 9 and 10.

Figure 13:
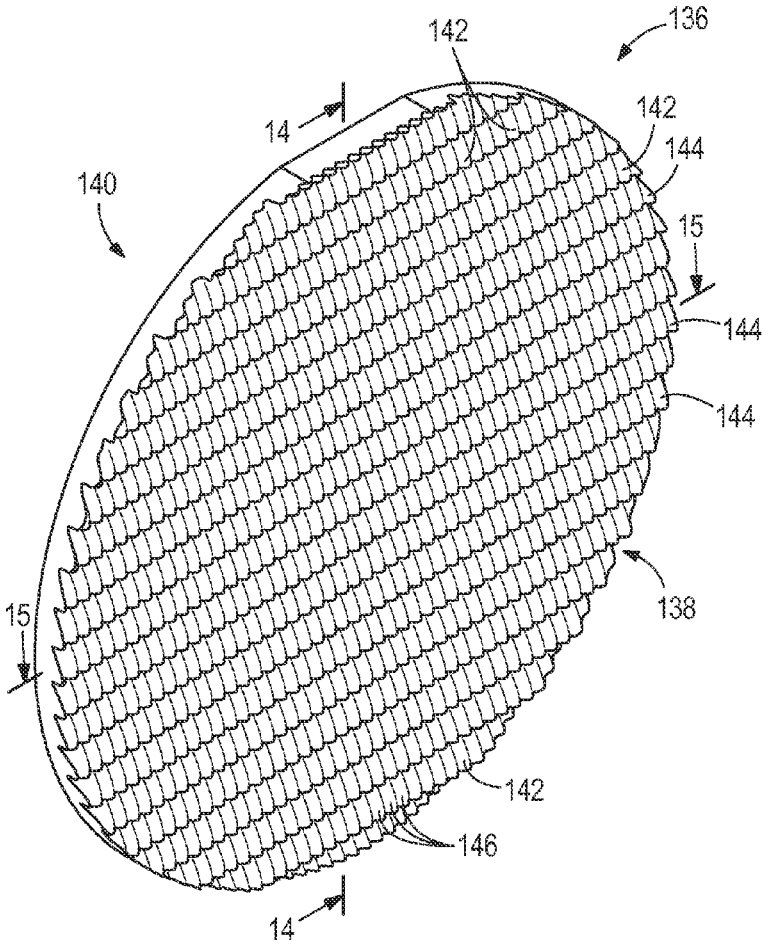
FIG. 13 is a perspective view of a third alternative lens for use in the luminaire of FIG. 1.
Figure 14:
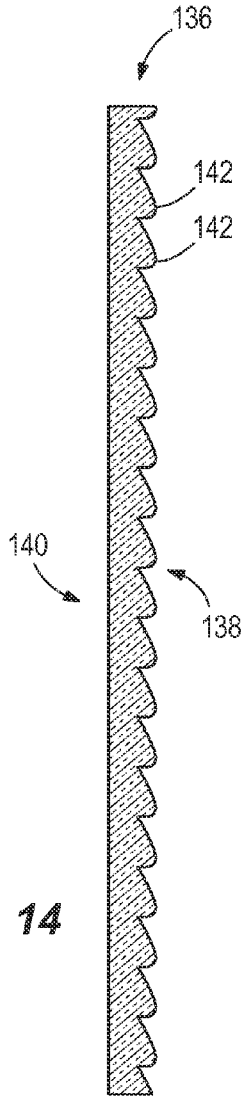
FIG. 14 is a cross-sectional view taken along lines 14-14 of FIG. 13.
Figure 15:
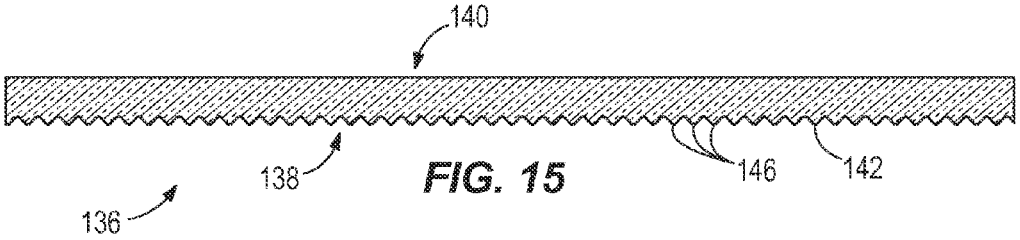
FIG. 15 is a cross-section view taken along lines 15-15 of FIG. 13.

FIGS. 13-15 illustrate a refracting lens 136 that can be used with the attachment 24 discussed above in lieu of either the lenses 58, 60, 100, or 120. The refracting lens 136 includes a first side 138 and a second side 140. The second side 140 is generally smooth. The first side 138 includes lenticular lenses 142. The lenses 142 are arranged in rows 144 that that extend horizontally across the first side 138 of the lens 136. The rows 144 of lenses 142 are stepped to provide the multi-stepped feature of the lenses 114 and 132 discussed above to spread the light vertically. Also, the lenses 142 are rounded and aligned in vertical columns 146 to be somewhat cylindrical vertical columns, similar to the cylindrical lenses 94, 108, and 130 discussed above, to spread the light beam horizontally. Accordingly, the lenses 142 have a periodic structure in both horizontal and vertical cross-sections. The illustrated lenses 142 accomplish similar light spreading as the lens 120 of FIGS. 11 and 12 but the lens 136 has a higher efficiency and simpler tooling/manufacturing because lenses are located on only a single side of the lens 136.

Figure 16:
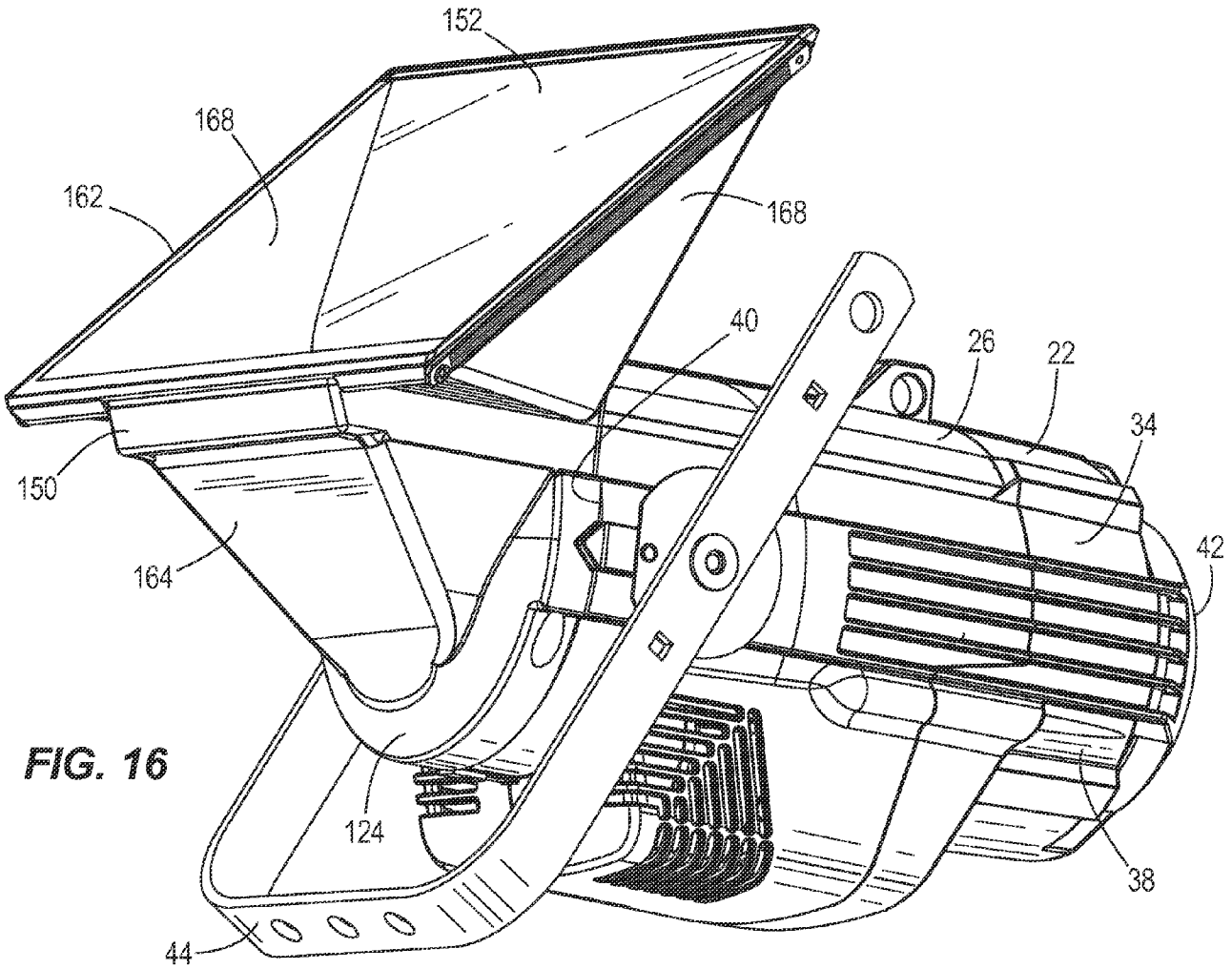
FIG. 16 is a perspective view of a luminaire according to another embodiment.
Figure 17:
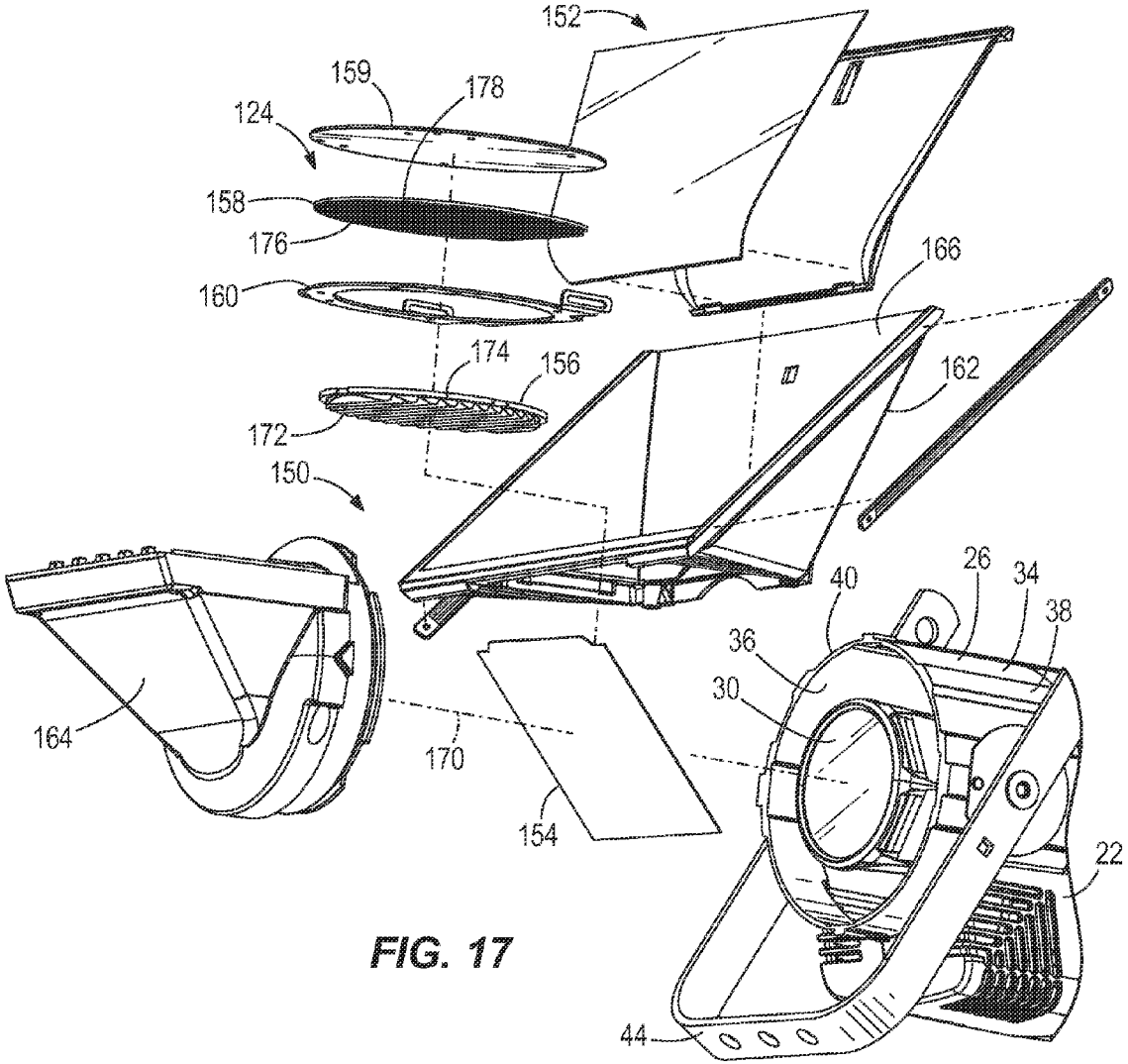
FIG. 17 is a partially exploded view of the luminaire of FIG. 16.

FIGS. 16-17 illustrate a light diffusing attachment 124 according to another embodiment that can be used with the light engine 22, discussed above. The light diffusing attachment 124 is removably attached to the light engine 22 so that the light engine 22 can quickly and easily be converted to a cyc light as discussed above with regard to the light diffusing attachment 24.

The light diffusing attachment 124 includes a frame 150, a steering mirror 152, a folding mirror 154, a first refracting lens 156, a second refracting lens 158, and a diffuser 159. A bezel 160 attaches the lenses 156, 158 and the steering mirror 152 to the frame 150.

The frame 150 includes an upper portion 162 and a lower portion 164. The lenses 156, 158 are attached to the lower portion 164 of the frame 150 and the folding mirror 154 is located within the lower portion 164. The lower portion 164 of the frame 150 inhibits unintentional access to the interior of the housing 26 of the light engine 22. The upper portion 162 of the frame 150 includes a rear wall 166 and sidewalls 168. The curved steering mirror 152 is attached to the rear wall 166 to reflect light. The frame 150 is removably coupled to the housing 26 as described above with respect to the frame 50 of the light diffusing attachment 24.

Referring to FIG. 17, the folding mirror 154 is positioned at about a 45 degree angle with respect to a longitudinal axis 170 of the housing 26. The folding mirror 154 redirects and reflects light (i.e., folds light) from the light engine 22 toward the lenses 156, 158. The first lens 156 includes a first side 172 and a second side 174. The first side 172 of the lens 156 is essentially the same as the second side 78 of the lens 58 of FIG. 5, described above. The first side 172 of the lens 156 spreads or steers light vertically asymmetrically to direct more light higher on the cyc or wall away from the light engine 22. The second side 174 of the lens 156 is smooth. The second lens 158 includes a first side 176 and a second side 178. The first side 176 is essentially the same as the first side 122 of the lens 120 of FIGS. 11 and 12. The first side 176 of the lens 158 spreads light horizontally symmetrically on the cyc or wall. The second side 178 of the second lens 158 is smooth. In other embodiments, the second lens 158 can also function as a diffuser for the light diffusing attachment 124 and the separate diffuser 159 can be omitted.

Figure 18:
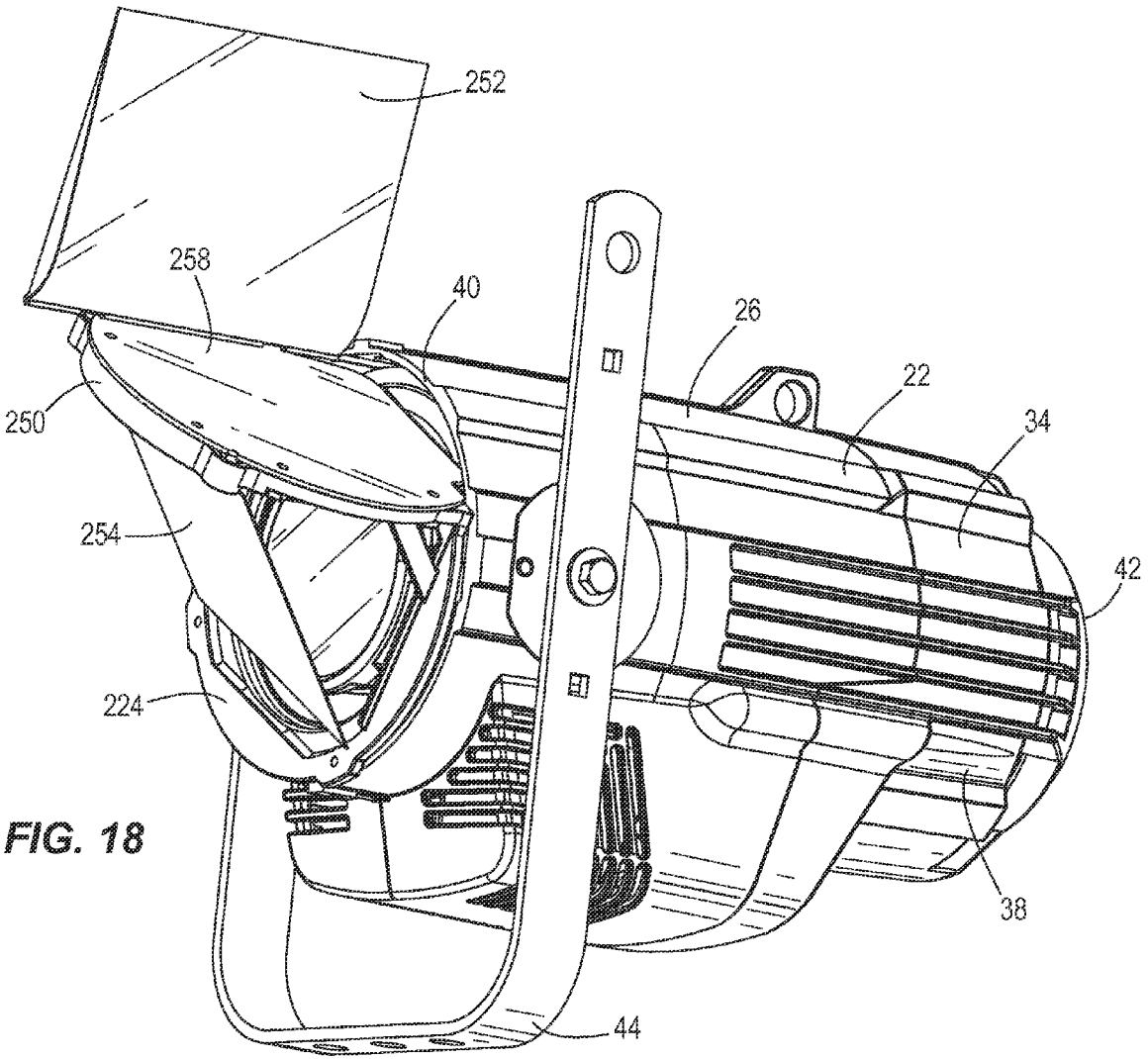
FIG. 18 is a perspective view of a luminaire according to another embodiment.
Figure 19:
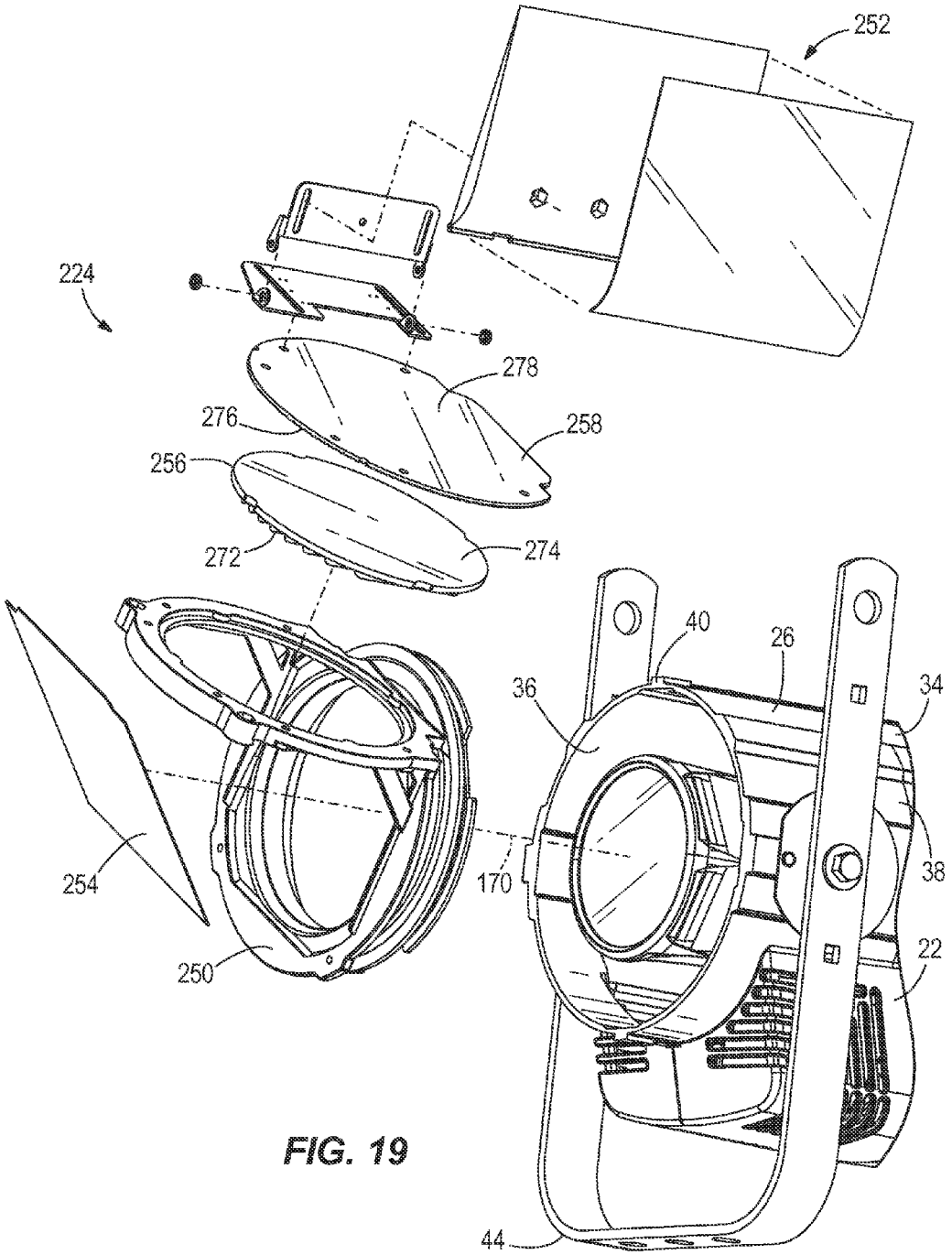
FIG. 19 is a partially exploded view of the luminaire of FIG. 18.

FIGS. 18-19 illustrate a light diffusing attachment 224 according to another embodiment that can be used with the light engine 22, discussed above. The light diffusing attachment 224 is similar to the light diffusing attachment 124 and only differences between the light diffusing attachments 124, 224 will be discussed in detail and like components have been given like reference numbers plus 100.

The light diffusing attachment 224 includes a frame 250, a steering mirror 252, a folding mirror 254, a first refracting lens 256, and a second refracting lens 258, which also functions as a diffuser in the illustrated embodiment. The lenses 256, 258, the folding mirror 254, and the steering mirror 252 are attached to the frame 250 for rotation with the frame 250 about the longitudinal axis 170 of the housing 26. Also, the steering mirror 252 is attached to the frame 250 so that the steering mirror 252 is generally parallel to the axis 170. In operation, the user positions the axis 170 generally parallel to the cyc or wall being illuminated. The user can then rotate the position of the frame 250 about the axis 170 to provide for a vertical adjustment of the light on the cyc. The user can also pivot the steering mirror 252 with respect to the frame 250 to provide further adjustment of the light on the cyc.

Figure 20:
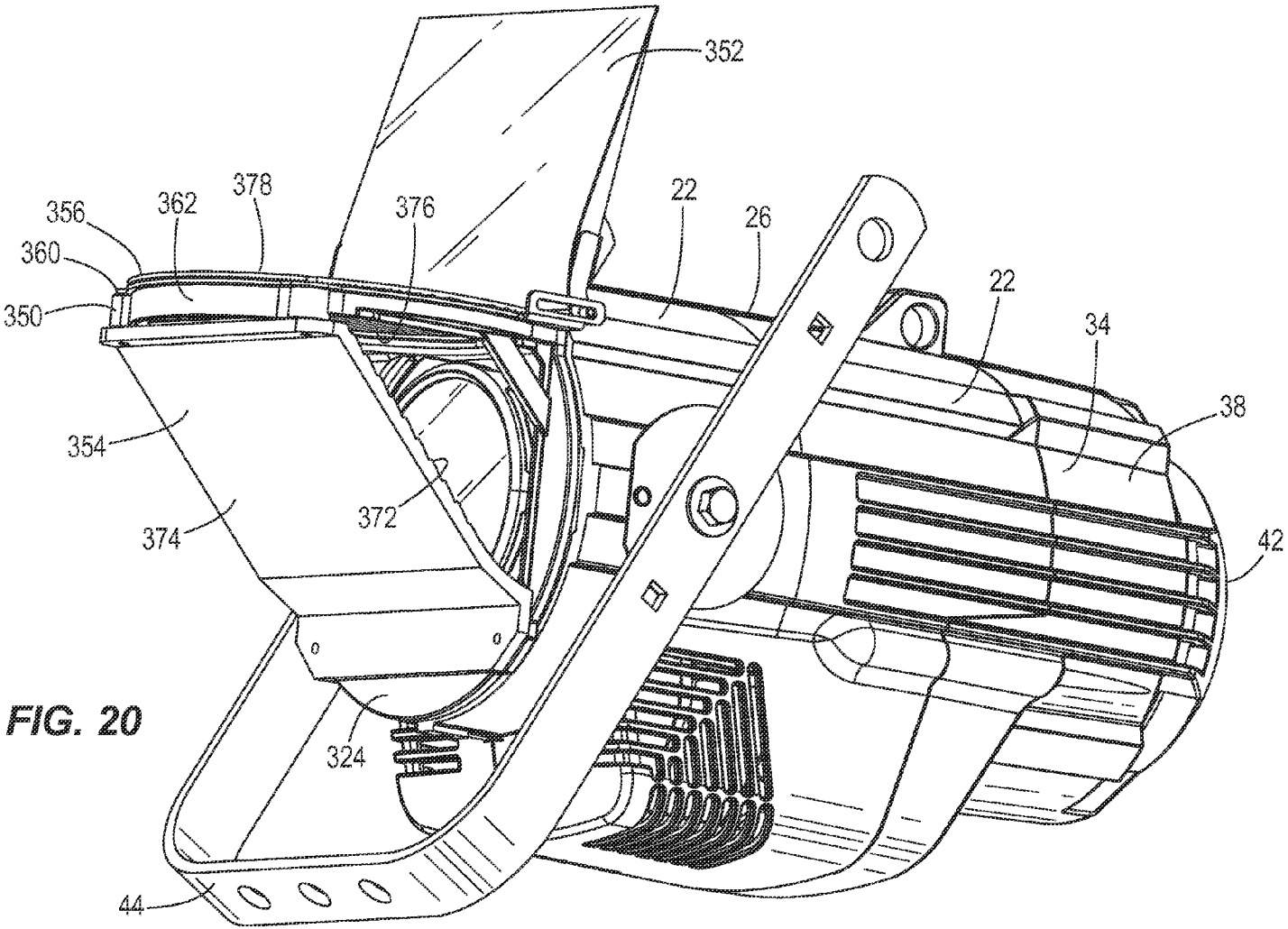
FIG. 20 is a perspective view of a luminaire according to another embodiment.
Figure 21:
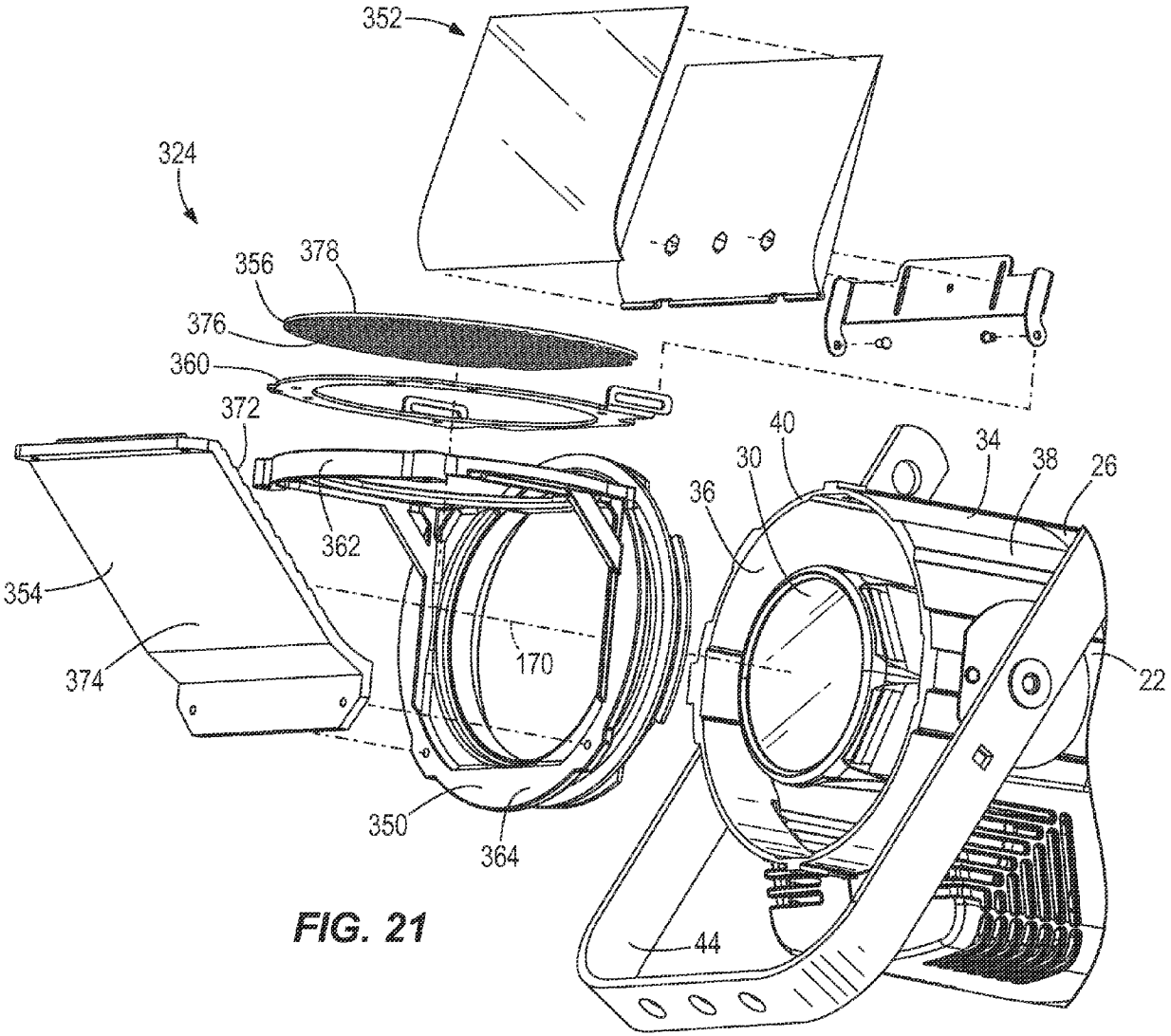
FIG. 21 is a partially exploded view of the luminaire of FIG. 20.

FIGS. 20-21 illustrate a light diffusing attachment 324 according to another embodiment that can be used with the light engine 22, discussed above. The light diffusing attachment 324 is removably attached to the light engine 22 so that the light engine 22 can quickly and easily be converted to a cyc light as discussed above with regard to the light diffusing attachment 24.

The light diffusing attachment 324 includes a frame 350, a steering mirror 352, a folding mirror 354 and a refracting lens 356, which also functions as a diffuser in the illustrated embodiment. A bezel 360 attaches the lens 356 and the steering mirror 352 to the frame 350.

The frame 350 includes a first portion 362 and a second portion 364 perpendicular to the first portion 362. The lens 356 and the steering mirror 352 attached to the first portion 362 of the frame 350 and the folding mirror 354 extends between the first portion 362 and the second portion 364 at generally a 45 degree angle relative to the longitudinal axis 170 of the housing 26. The frame 350 is removably coupled to the housing 26 as described above with respect to the frame 50 of the light diffusing attachment 24.

The folding mirror 354 is positioned at about a 45 degree angle with respect to the longitudinal axis 170 of the housing 26 to reflect and redirect light from the light engine 22 toward the lens 356. The folding mirror 354 includes a first side 372 and a second side 374. The first side 372 of the folding mirror 354 is reflective but has essentially the same surface profile as the first side 172 of the lens 156 of FIGS. 16 and 17 (i.e., essentially the same surface profile as the second side 78 of the lens 58 of FIG. 5, described above). Therefore, the first side 372 of the folding mirror 354 spreads or steers light vertically asymmetrically to direct more light higher on the cyc or wall away from the light engine 22. The lens 356 includes a first side 376 and a second side 378. The first side 376 is essentially the same as the first side 122 of the lens 120 of FIGS. 11 and 12. The first side 376 of the lens 356 spreads light horizontally symmetrically on the cyc or wall. The second side 378 of the lens 356 is smooth. The lens 356 also functions as a diffuser for the light diffusing attachment 324. The steering mirror 352 is pivotally attached to the frame 350 so that the user can adjust the mirror 352 to adjust the position of the light on the cyc.

In one application, multiple light engines 22 with different light diffusing attachments 24, 124, 224, 324, discussed above, can be used on a cyc to create different lighting effects. For example, three light engines 22 each with the light diffusing attachment 24 are placed at the top of the cyc and generally directed downwardly onto the cyc. Three light engines 22 each with the light diffusing attachment 124 (FIGS. 16-17) are placed at the bottom of the cyc (e.g., on the floor) and generally directed downward toward the floor by rotating the light diffusing attachment 124 by 180 degrees with respect to the light engine 22, about the supporting flange 64.

This combination and arrangement of cyc lights has been found to create a particularly desirable sunrise or sunset effect on the cyc. In other applications, other arrangements and combinations of light engines 22 and light diffusing attachments 24, 124, 224, and 324 are possible to create other types of lighting effects.

Thus, the invention provides, among other things, a luminaire that can easily and quickly be converted to a cyc light. Various features and advantages of the invention are set forth in the following claims.

What is claimed is:

1. A light-diffusing attachment for a light engine having a housing, comprising:

a frame adapted to be secured to the housing of the light engine;

a refracting lens supported by the frame; and a diffuser supported by the frame, wherein the refracting lens comprises a lenticular lens, wherein the lenticular lens includes a first array with a first orientation and a second array with a second orientation different than the first orientation.

2. A light-diffusing attachment as claimed in claim 1, further comprising a folding mirror supported by the frame that directs light from the light engine to the refracting lens and the diffuser.

3. A light-diffusing attachment as claimed in claim 2, wherein the folding mirror includes an array of stepped mirrors.

4. A light-diffusing attachment as claimed in claim 1, wherein the lenticular lens comprises a surface having a central region including prisms and peripheral regions comprising lenticular lenses.

5. A light-diffusing attachment as claimed in claim 1, wherein the lenticular lens comprises a double-sided lenticular lens.

6. A light-diffusing attachment as claimed in claim 1, wherein the lenticular lens includes a first lens having the first array and a second lens having the second array.

7. A light-diffusing attachment as claimed in claim 1, wherein the first orientation is substantially ninety degrees rotated relative to the second orientation.

8. A light-diffusing attachment as claimed in claim 1, wherein the first array comprises stepped lenses.

9. A light-diffusing attachment as claimed in claim 1, wherein the frame includes a supporting flange that at least partially defines a groove that extends at least partially around the frame, the groove configured to receive a portion of the housing to removably couple the frame and the housing.

10. A light-diffusing attachment as claimed in claim 9, wherein the flange includes an opening configured to allow the portion of the housing to pass through the opening to facilitate coupling the frame and the housing.

11. A light-diffusing attachment for a light engine having a housing, comprising:

a frame adapted to be secured to the housing of the light engine;

a refracting lens supported by the frame;

a diffuser supported by the frame; and a folding mirror supported by the frame that directs light from the light engine to the refracting lens and the diffuser, wherein the refracting lens includes a first array with a first orientation and a second array with a second orientation different than the first orientation.

12. A light-diffusing attachment as claimed in claim 11, wherein the folding mirror includes an array of stepped mirrors.

13. A luminaire comprising:

a light engine having a light source and a housing; and a light-diffusing attachment, comprising:

a frame secured to the housing of the light engine;

a refracting lens supported by the frame; and a diffuser supported by the frame, wherein the refracting lens comprises a lenticular lens, wherein the lenticular lens includes a first array with a first orientation and a second array with a second orientation different than the first orientation.

14. A luminaire as claimed in claim 13, wherein the light-diffusing attachment further includes a folding mirror supported by the frame that directs light from the light engine to the refracting lens and the diffuser.

15. A luminaire as claimed in claim 14, wherein the folding mirror includes an array of stepped mirrors.

16. A luminaire as claimed in claim 13, wherein the lenticular lens comprises a surface having a central region including prisms and peripheral regions comprising lenticular lenses.

17. A luminaire as claimed in claim 13, wherein the lenticular lens comprises a double-sided lenticular lens.

18. A luminaire as claimed in claim 13, wherein the lenticular lens comprises a first lens having the first array and a second lens having the second array.

19. A luminaire as claimed in claim 13, wherein the first orientation is substantially ninety degrees rotated relative to the second orientation.

20. A luminaire as claimed in claim 13, wherein the first array comprises stepped lenses.

21. A luminaire as claimed in claim 13, wherein the frame includes a supporting flange that at least partially defines a groove that extends at least partially around the frame, wherein the light engine includes a tab located within the housing, and wherein the groove receives the tab to removably couple the frame and the housing.

22. A luminaire as claimed in claim 21, wherein the flange includes an opening that allows the tab to pass through the opening to facilitate coupling the frame and the housing.

23. A luminaire comprising:

a light engine having a light source and a housing; and a light-diffusing attachment, comprising:

a frame secured to the housing of the light engine;

a refracting lens supported by the frame;

a diffuser supported by the frame; and a folding mirror supported by the frame that directs light from the light engine to the refracting lens and the diffuser, wherein the refracting lens includes a first array with a first orientation and a second array with a second orientation different than the first orientation.

24. A luminaire as claimed in claim 23, wherein the folding mirror includes an array of stepped mirrors.

* * * * *